US006269972B1

(12) United States Patent
Smithson

(10) Patent No.: US 6,269,972 B1
(45) Date of Patent: Aug. 7, 2001

(54) DISPENSERS FOR BAGS

(75) Inventor: Martin Dominic Smithson, Worcestershire (GB)

(73) Assignee: Cascade Dispensers Limited Grove House, Worcestershire (GB)

( * ) Notice: Subject to any disclaimer, the term of this patent is extended or adjusted under 35 U.S.C. 154(b) by 0 days.

(21) Appl. No.: 09/375,919

(22) Filed: Aug. 17, 1999

(30) Foreign Application Priority Data

Oct. 20, 1998 (GB) ..... 9822943

(51) Int. Cl.[7] ..... B65H 1/00
(52) U.S. Cl. ..... 221/33; 206/554
(58) Field of Search ..... 221/33, 45, 34, 221/35, 38, 48, 63, 303; 206/554, 812

(56) References Cited

U.S. PATENT DOCUMENTS

| | | | |
|---|---|---|---|
| 3,249,255 | | 5/1966 | Cohen . |
| 3,352,411 | | 11/1967 | Schwarzkopf . |
| 3,392,824 | | 7/1968 | Gale et al. . |
| 3,485,413 | * | 12/1969 | Vestal ..... 221/33 |
| 4,349,123 | | 9/1982 | Yang . |
| 4,597,494 | | 7/1986 | Benoit . |
| 4,611,728 | | 9/1986 | Compton et al. . |
| 4,624,365 | | 11/1986 | Derdyk . |
| 4,714,643 | * | 12/1987 | Kuenzel ..... 206/554 |
| 4,721,226 | | 1/1988 | Yurko . |
| 4,790,437 | | 12/1988 | Pistner . |
| 4,819,806 | | 4/1989 | Pistner . |
| 4,840,610 | | 6/1989 | Pistner . |

FOREIGN PATENT DOCUMENTS

| | | | |
|---|---|---|---|
| 24 24 633 | | 12/1975 | (DE) . |
| 0 790 023 A2 | | 8/1997 | (EP) . |
| 1269157 | * | 4/1972 | (GB) . |
| 1 269 157 | | 4/1972 | (GB) . |
| 2 074 531 | | 11/1981 | (GB) . |
| 2 088 329 | | 6/1982 | (GB) . |
| 2269367 | | 2/1994 | (GB) . |
| 2 299 068 | | 9/1996 | (GB) . |
| WO 93/08720 | | 5/1993 | (WO) . |

* cited by examiner

*Primary Examiner*—Kenneth W. Noland
(74) *Attorney, Agent, or Firm*—Richardson & Folise

(57) ABSTRACT

A method for retaining a stack 1 of removably mutually connected pre-formed plastic bags 2, e.g. in supermarkets, comprises supporting the stack in a dispenser in a laterally (side-to-side) folded-over condition thereby presenting a spine of the fold, with the spine of the fold presented so as to be accessible to be grasped between a thumb and fingers of a person seeking to remove an individual bag 2 from the stack by pulling in direction A.

The stack includes a block of lips 3, to which each bag is connected via a line of weakness 8 defining a rim 9 of the bag.

A dispenser for dispensing plastic bags in accordance with this method is also described and claimed. The dispenser can suitably include a cantilevered shaft passing through the block of lips 3 via a through-hole 5.

2 Claims, 1 Drawing Sheet

DISPENSERS FOR BAGS

CROSS-REFERENCE TO RELATED APPLICATIONS

This application claims priority from co-pending United Kingdom patent application No. 9822943.8 filed on Oct. 20, 1998.

TECHNICAL FIELD

This invention relates to a method and apparatus whereby individual pre-formed bags can be dispensed from a stack of such bags.

BACKGROUND OF THE ART

It is common practice to provide, for example in supermarkets and other retail outlets, dispensers for dispensing pre-formed bags (e.g. plastic bags) from a stack of such bags.

In one known arrangement, plastic bags are each provided in a stack with a so-called "lip", i.e. a circumferential web of plastic extending beyond the rim of the bag, the rim being defined by a line of weakness (e.g. a line of perforations) between the bag and the lip. By securing ("blocking") the lips together the stack of bags is formed and individual bags can be detached from the stack by pulling the top bag of the stack until the line of weakness holding it to the stack breaks. An example of such an arrangement is shown in PCT patent application Ser. No. WO-93/08720, the disclosure of which is incorporated herein by reference.

Such stacks are typically suspended from the blocked lips by a variety of simple means, e.g. hanging from hooks, pegs, pieces of string, etc. Light gauge bags are typically used to package small goods bought at stationers, news agents, pharmacies, confectioners and some parts of department stores or supermarkets. Therefore, there is a need for a dispensing system that enables shop assistants to obtain a single bag quickly and efficiently, and in a way that provides an open bag in the shop assistant's hand.

The known dispensing systems suffer from the general disadvantage that plastic bags are not particularly easy to grasp. Electrostatic charges can build up on them, causing neighbouring bags to stick together and the act of grasping a bag from a stack is not always easy, particularly under conditions of work pressure. Some shop assistants have tried to overcome this problem by licking their fingers before grasping a bag, but this practice is unsatisfactory, unhygienic and not particularly effective.

It is an aim of the present invention to go at least some way towards overcoming the above disadvantages, or at least to provide an acceptable alternative to the known arrangements, which is applicable to all types of bag, whether of light or heavier gauge plastic or with or without handles.

SUMMARY OF THE INVENTION

In accordance with a first aspect of the present invention, therefore, there is provided a method for retaining a stack of removably mutually connected pre-formed bags, preferably (but not essentially) of the light-gauge plastic type, in a manner whereby individual bags can be readily grasped and removed from the stack, the method comprising supporting the stack in a laterally (side-to-side) folded-over condition with the spine of the fold presented so as to be accessible to be grasped between the thumb and fingers of a person seeking to remove an individual bag from the stack.

We have surprisingly found that when a stack of bags is folded laterally over (side-to-side, e.g. in the manner of a book), and then the bag at the top of the fold is grasped across the spine of the fold (i.e. with the spine between the thumb and fingers), that top bag can be very neatly and efficiently pulled from the stack simply by closing a grasp onto the folded stack and drawing the top bag off the spine of the folded stack. The removed bag is found consistently to be well opened and ready to use in the person's hand.

The method has been found to be particularly useful with light gauge plastic bags, where the stack includes a blocked lip to which each bag is connected via a line of weakness. However, the method has more general applicability and its scope is not restricted only to such bags.

By avoiding the need to physically grasp and individual bag at the start of the removal procedure, the chance of inadvertently grasping two bags is eliminated. Moreover, the sliding operation, in which initially the top bag of the folded stack is gently slid over the next bag to start the process of breaking the top bag away from the stack, is much more gentle and carries with it much less risk of damaging the remainder of the stack than has been found hitherto. The natural balance of stickiness and slipperiness of the adjacent bags when sliding one over the other is thus employed to advantage, rather than to disadvantage as was previously the case.

Furthermore, the pull on the top bag is directed substantially along the line of weakness by which the bag is connected to the block, rather than across the line of weakness as was the case in previous systems. This causes a much neater and more efficient tearing of the bag away from the stack.

In accordance with a second aspect of the present invention, there is provided a dispenser for dispensing individual pre-formed bags, preferably (but not essentially) of the light gauge plastic type, from a stack of removably mutually connected such bags, the dispenser comprising a body part and an anchor part for the stack, the anchor part being disposed on the body part, the anchor part being adapted to engage the stack and the arrangement including a stack of bags engaged on the anchor part and supported in a laterally (side-to-side) folded-over condition with the spine of the fold presented so as to be accessible to be grasped between the thumb and fingers of a person seeking to remove an individual bag from the stack, whereby individual bags can be readily grasped and removed from the stack.

The body part may preferably be a base part fixedly mounted to a support. The anchor part may preferably be a single hook or a rod or shaft adapted to pass through holes in the stack of bags (i.e. through-holes in the blocked lips of the stack). Most preferably, a pair of through-holes is provided in the stack of bags, each about 25% of the lateral stack width in from the opposed lateral edges of the stack. On folding such a stack laterally along the centre of the stack so that one side overlies the opposite side of the stack, both holes can thereby receive the single hook, rod or shaft constituting the anchor part, so retaining the stack suspended from the rod or shaft in substantially laterally (side-to-side) folded-over condition.

The dispenser itself can be a very simple construction, at its preferable minimum consisting essentially of a hook or cantilevered rod, bar or shaft (anchor part) mounted to a support plate (body part), onto which hook, rod, bar or shaft a stack of bags can be engaged in folded-over manner. This leads to readily apparent economic and technical advantages.

In accordance with a third aspect of the present invention, there is provided a stack of light gauge plastic bags in use in a dispenser according to the second aspect of the present invention, the stack comprising a plurality of such bags mutually removably connected to a block of lips, each lip comprising a plastic web extending circumferentially from the rim of a bag and connected to the bag via a line of weakness, the stack characterised in that at least two through-holes are provided in the block to receive an anchor part of the dispenser, each through-hole being located in from the lateral edges of the stack by a distance equivalent to about 25% of the width of the stack.

It is most preferred that the block of lips should use the minimum amount of plastic, as the block is wasted and thrown away after the stack has been used. For example, the block of lips should extend no more than about 2–3 mm beyond the rims of the bags as defined by the lines of weakness.

For a better understanding of the invention, and to show how the same may be carried into effect, an embodiment will now be described, without limitation and purely by way of example, with reference to the accompanying drawings, in which:

BEST MODE FOR CARRYING OUT THE INVENTION

Figure 1:
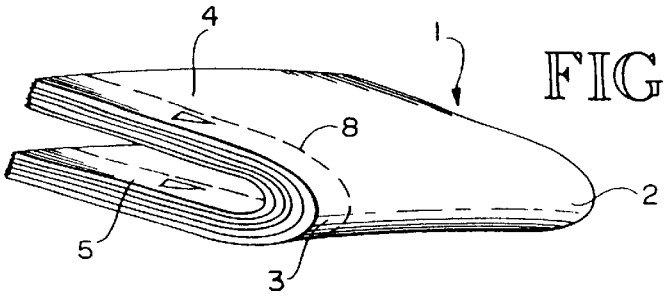
FIG. 1 shows a perspective view of a folded-over stack of bags.
Figure 2:
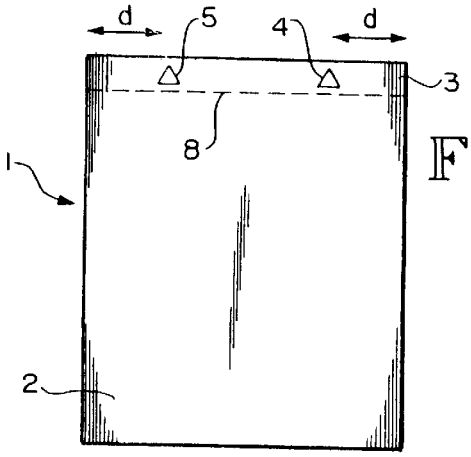
FIG. 2 shows the stack of bags unfolded, for clarity.

Referring to the drawings, a stack 1 of light gauge plastic bags 2 of the type described above is provided in its block of lips 3 with a pair of through-holes 4, 5, each set in from the edge of the stack by a distance d, being 25% of the width of the stack.

Figure 3:
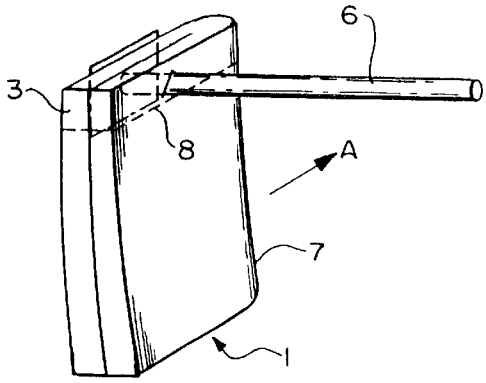
FIG. 3 shows the stack of bags engaged on a dispenser.
Figure 4:
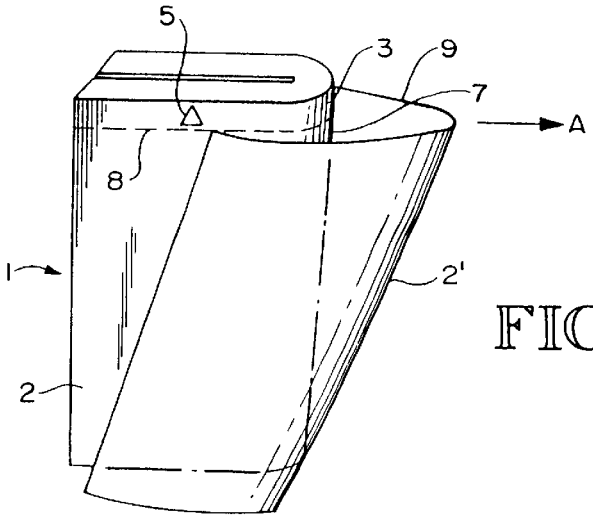
FIG. 4 illustrates the removal of a bag from the dispenser (omitting the support bar for clarity).

The stack is folded laterally (side-to-side) on itself and a cantilevered bar 6 (e.g. of metal) constituting the dispenser is engaged through the holes 4, 5, to suspend the stack in laterally (side-to-side) folded-over condition. As shown particularly in FIGS. 3 and 4, to remove a single bag from the stack, the top bag 2' of the folded stack is grasped between thumb and fingers (not shown) across the spine 7 of the stack and pulled in the direction of arrow A off the spine. The bag detaches from the block 3 by breaking at the line of weakness 8 (typically, a line of perforations) defining the rim 9 of the bag, and is removed from the stack in a very neat and efficient manner.

Moreover the construction, installation, maintenance and reloading of the dispenser are extremely simple.

The foregoing broadly describes the invention without limitation. Variations and modifications as will be readily apparent to those of ordinary skill in this art are intended to be included within the scope of this application and subsequent patent(s).

What is claimed is:

1. A method for retaining a stack of removably mutually connected pre-formed bags, in a manner whereby individual bags can be readily grasped and removed from the stack, the method comprising supporting the stack in a laterally (side-to-side) folded-over condition thereby presenting a spine of the fold, with the spine of the fold presented so as to be accessible to be grasped between a thumb and fingers of a person seeking to remove an individual bag from the stack, in which the stack includes a blocked lip to which each bag is connected via a line of weakness.

2. The method of claim 1 in which the bags are light-gauge plastic bags.

* * * * *